US007287967B2

(12) United States Patent
Asayama et al.

(10) Patent No.: US 7,287,967 B2
(45) Date of Patent: Oct. 30, 2007

(54) HIGH-PRESSURE PUMP HAVING SMALL INITIAL AXIAL FORCE OF A CLAMPING BOLT

(75) Inventors: Kazuhiro Asayama, Nagoya (JP); Hirokazu Yokoyama, Toyota (JP); Shinobu Ishida, Toyota (JP); Hiroshi Inoue, Chiryu (JP)

(73) Assignees: Toyota Jidosha Kabushiki Kaisha, Toyota-shi (JP); Denso Corporation, Kariya-shi (JP)

( * ) Notice: Subject to any disclaimer, the term of this patent is extended or adjusted under 35 U.S.C. 154(b) by 0 days.

(21) Appl. No.: 10/257,651

(22) PCT Filed: Apr. 17, 2001

(86) PCT No.: PCT/JP01/03260

§ 371 (c)(1),
(2), (4) Date: Oct. 16, 2002

(87) PCT Pub. No.: WO01/79687

PCT Pub. Date: Oct. 25, 2001

(65) Prior Publication Data

US 2003/0103853 A1 Jun. 5, 2003

(30) Foreign Application Priority Data

Apr. 18, 2000 (JP) ..... 2000-116421

(51) Int. Cl.
*F04B 19/00* (2006.01)

(52) U.S. Cl. ..... 417/470; 92/171.1

(58) Field of Classification Search ..... 417/470, 417/471, 505, 490; 91/171.1, 169.1, 164
See application file for complete search history.

(56) References Cited

U.S. PATENT DOCUMENTS 3,981,634 A * 9/1976 Staudt et al. ..... 417/499
4,060,350 A * 11/1977 Indra ..... 417/490
4,073,277 A * 2/1978 Eheim ..... 123/501
4,450,685 A * 5/1984 Corey ..... 60/520
4,619,239 A 10/1986 Wallenfang et al.

(Continued)

FOREIGN PATENT DOCUMENTS

EP 0 114 375 A2 1/1984

(Continued)

OTHER PUBLICATIONS

First Office Action, issued Apr. 1, 2005, Patent Office of the People's Republic of China.

(Continued)

*Primary Examiner*—Michael Koczo, Jr.
(74) *Attorney, Agent, or Firm*—Kenyon & Kenyon LLP

(57) ABSTRACT

A high pressure pump for preventing distortion of a sealing surface or a cylinder form. The high pressure pump has an intermediate member including a cylinder body having a pressurizing chamber communicated with a cylinder accommodating a plunger. Fluid in the pressurizing chamber is pressurized by reciprocating the plunger. The intermediate member is arranged between a cover and a flange and is clamped by clamping bolts. An electromagnetic spill valve for receiving reaction force from the pressurizing chamber when the fluid in the pressurizing chamber is pressurized is attached to the cover at a position for reducing the clamping force applied to the intermediate member by the clamping bolts.

9 Claims, 5 Drawing Sheets

U.S. PATENT DOCUMENTS

| | | | | |
|---|---|---|---|---|
| 4,705,006 | A | 11/1987 | Bastenhof | 123/506 |
| 4,738,493 | A * | 4/1988 | Inagaki et al. | 303/116.1 |
| 5,092,744 | A * | 3/1992 | Boers et al. | 417/397 |
| 5,362,215 | A * | 11/1994 | King | 417/455 |
| 5,807,085 | A * | 9/1998 | Yajima | 417/505 |
| 5,921,760 | A * | 7/1999 | Isozumi et al. | 417/470 |
| 5,967,113 | A * | 10/1999 | Kaneko et al. | 123/295 |
| 6,171,081 | B1 * | 1/2001 | Nakajima et al. | 417/470 |
| 6,554,590 | B2 * | 4/2003 | Maeda et al. | 417/505 |
| 6,783,333 | B2 * | 8/2004 | Wang | 417/307 |

FOREIGN PATENT DOCUMENTS

| | | |
|---|---|---|
| GB | 1 579 711 | 11/1980 |
| GB | 2 107 801 A | 5/1983 |
| GB | 2 269 209 A | 2/1994 |
| JP | 58131354 | 8/1983 |
| JP | 09-100760 | 4/1997 |
| JP | 09-250427 | 9/1997 |
| JP | 10-018941 | 1/1998 |
| JP | 10-030526 | 2/1998 |
| JP | 10073064 | 3/1998 |
| JP | 11 082236 A | 3/1999 |
| JP | 11-082239 | 3/1999 |
| JP | 11-210598 | 8/1999 |
| JP | 2000-045907 | 2/2000 |

OTHER PUBLICATIONS

Japanese Office Action for Appln. No. JP 2000-116421 issued Jun. 6, 2006.

Japanese Language Version of Japanese Office Action for Appln. No. JP 2000-116421, issued Sep. 12, 2006.

* cited by examiner

HIGH-PRESSURE PUMP HAVING SMALL INITIAL AXIAL FORCE OF A CLAMPING BOLT

BACKGROUND OF THE INVENTION

The present invention relates to a high pressure pump, and more particularly, to a high pressure pump having an intermediate member, which includes a cylinder body to pressurize fluid in a pressurizing chamber by reciprocating a plunger in a cylinder and which is arranged between two clamping members, the intermediate member being clamped by a clamping bolt, which extends between the two clamping members, by means of the clamping members.

For example, Japanese Laid-Open Patent Publication No. 11-210598 discloses a high pressure fuel pump used for an engine such as a cylinder injection type gasoline engine. In the high pressure fuel pump, to improve the machining characteristics and assembling characteristics, an intermediate member such as a sleeve (corresponding to cylinder body) is clamped between members such as a bracket along the axial direction and fastened to a casing by a clamping bolt.

Further, in the high pressure fuel pump, if the sleeve is just clamped, its cylinder form tends to be easily deformed. Therefore, a slit is formed between a clamping portion of the sleeve and the cylinder. The slit prevents the deformation caused by clamping cylindrical clamping members from affecting the cylinder form.

However, the clamping bolt for clamping the sleeve requires a relatively large initial, axial force. This is because the initial, axial force includes not only the axial force required for sealing the intermediate member but also requires the axial force required for coping with changes in the axial force resulting from fuel pressure pulsation that is produced when the high pressure pump is activated. Therefore, taking into consideration the change in the axial force of the high pressure pump, the intermediate member must be clamped with a relatively large initial, axial force when manufactured. However, when the intermediate member is clamped by a large initial, axial force with the clamping bolt, deformation of a sealing surface of the intermediate member or deformation of the cylinder form occurs. It is difficult to prevent such distortion.

BRIEF SUMMARY OF THE INVENTION

It is an object of the present invention to provide a high pressure pump and a coupling structure of a high pressure pump having small initial axial force of a clamping bolt and being capable of preventing distortion of a sealing surface or a cylinder form.

One aspect of the present invention provides a high pressure pump having an intermediate member including a cylinder body having a pressurizing chamber communicated with a cylinder accommodating a plunger. Fluid in the pressurizing chamber is pressurized by reciprocating the plunger. The high pressure pump includes two clamping members arranged on two sides of the intermediate member, a clamping bolt extending between the two clamping members to clamp the intermediate member with the two clamping members, and a member for receiving reaction force from the pressurizing chamber when the fluid in the pressurizing chamber is pressurized. The member for receiving the reaction force is attached to one of the two clamping members at a position for reducing the clamping force applied to the intermediate member by the clamping bolt.

In this structure, the member for receiving the reaction force is attached so that the reaction force of the pressurizing chamber is applied to the clamping member to reduce the clamping force applied to the intermediate member. Therefore, even if the reaction force of the pressurizing chamber, which is produced by fluid pressure pulsation during operation of the high pressure pump, is applied to the clamping member, the member for receiving the reaction force decreases the reaction force produced by the clamping of the intermediate member. Accordingly, the total reaction force becomes smaller than a sum of the reaction force of the pressurizing chamber and the reaction force produced when by clamping the intermediate member. The change of axial force caused by the fluid pressure pulsation during operation of the high pressure pump decreases. As a result, the initial axial force is decreased, and distortion of a sealing surface or a cylinder form is prevented.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION

Figure 1:
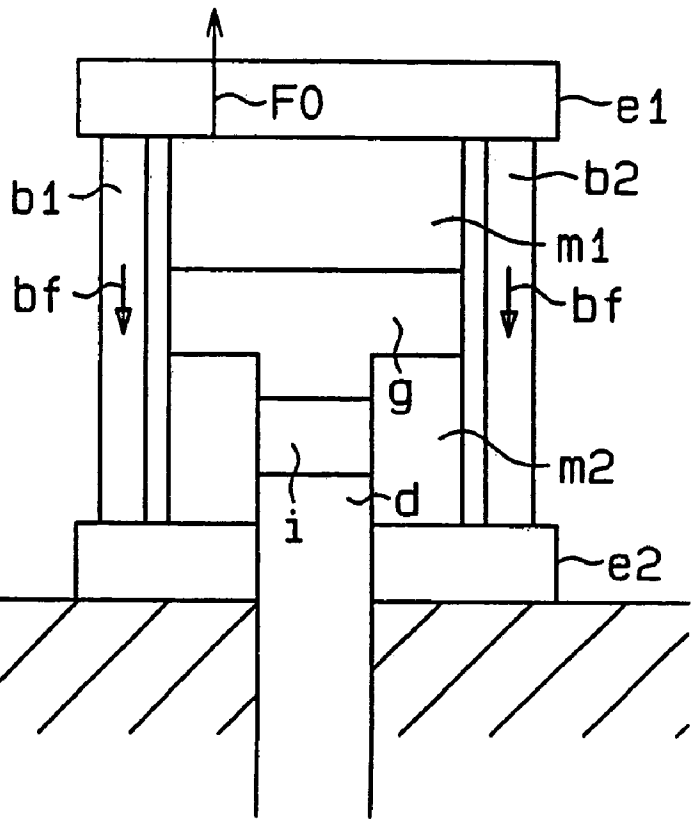
PRIOR ART Fig.1 (B)
FIG. 1(A) is a schematic diagram of a high pressure pump according to the present invention in a stationary state.
FIG. 1(B) is a schematic diagram of a prior art high pressure pump in an stationary state.
Figure 1:
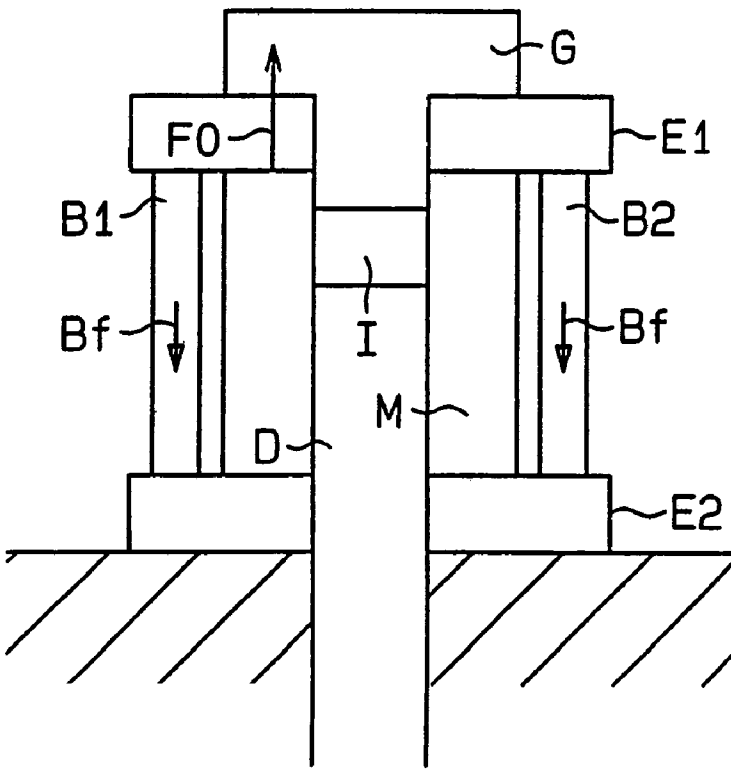

Before describing a high pressure pump according to an embodiment of the present invention, the principle of the present invention will be discussed. In the high pressure pump of the present invention, which is schematically shown in FIG. 1(A), an intermediate member M including a cylinder body is arranged between two clamping members E1, E2. The intermediate member M is clamped between the clamping members E1, E2 by clamping bolts B1, B2, which extend between the clamping members E1, E2. A member G is attached the clamping member E1 on the side that is opposite to the side where the intermediate member M is clamped. When fluid in a pressurizing chamber I is compressed by a plunger D and pressurized, the member G receives reaction force from the pressurizing chamber I.

In the high pressure pump of FIG. 1(A), when the intermediate member M is clamped by the clamping bolts B1, B2, the intermediate member M is elastically deformed and reaction force F0 is generated. The relationship between the reaction force F0 and the axial force Bf produced by the clamping bolts B1, B2 is represented by the following equation [1].

$$F0=2\cdot Bf \quad [1]$$

In a prior art high pressure pump, which is shown in FIG. 1(B), when fluid is compressed and pressurized in a pressurizing chamber I by a plunger d, a member g receives reaction force from the pressurizing chamber i. The member g and intermediate members m1, m2 are arranged between two clamping members e1, e2. In this case, when the intermediate members m1, m2 and the member g are clamped by the clamping bolts b1, b2, the intermediate members m1, m2 and the member g are elastically deformed and the reaction force F0 is generated. The relationship between the clamping bolts b1, b2 and the axial force bf is represented by the following equation [2].

$$F0=2\cdot bf \quad [2]$$

Accordingly, the relationship between the reaction force f0 and the axial force is the same in equations [1] and [2]. Therefore, in tightening when the high pressure pump stops, the axial force Bf of the clamping bolts B1, B2 of FIG. 1(A) is set same as the axial force bf of the clamping bolts b1, b2 of FIG. 1(B).

Figure 2B:
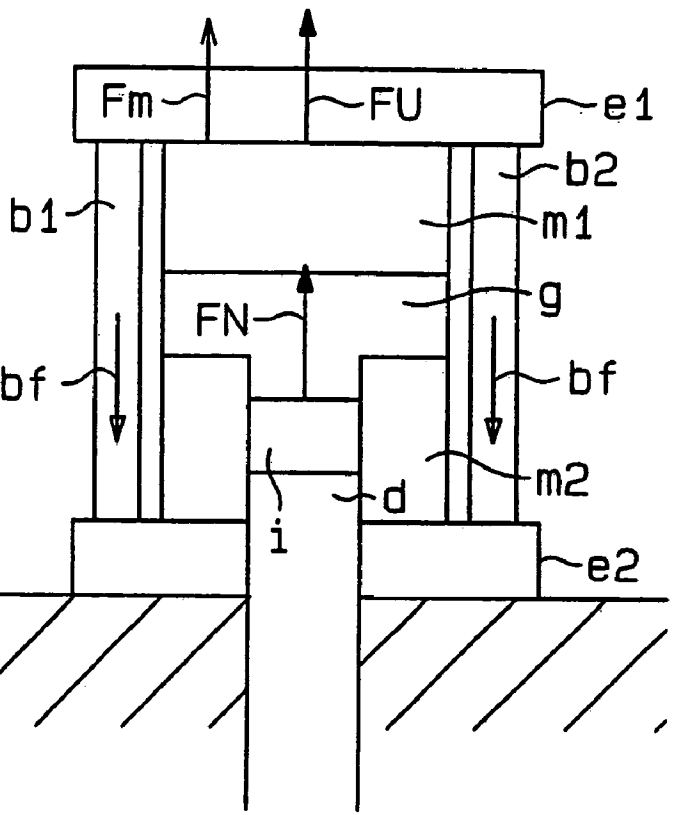
PRIOR ART Fig.2(B)
FIG. 2(B) is a schematic diagram of a prior art high pressure fuel pump in a dynamic state.
Figure 2A:
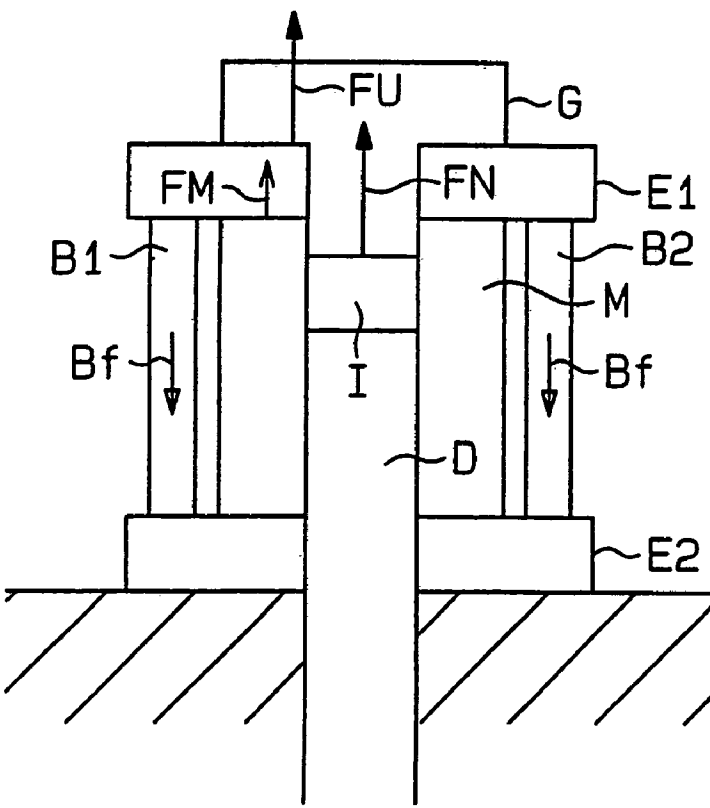
FIG. 2(A) is a schematic diagram of a high pressure pump according to the present invention in a dynamic state.

However, when reaction force FN is generated as the pressurizing chamber I is pressurized, the member G receives the reaction force FN from the pressurizing chamber I in the high pressure pump of the present invention shown in FIG. 2(A). Because the member G is arranged on the side opposite to the clamping side of the intermediate member M, the reaction force FN acts as a lifting force FU applied to the clamping member E1. The lifting force FU is an element of the axial force Bf generated at the clamping bolts B1, B2. Another element of the axial force Bf is reaction force FM from the intermediate member M. Therefore, the axial force Bf is represented by the following equation [3].

$$2\cdot Bf=FU+FM \quad [3]$$

The reaction force FM from the intermediate member M decreases the clamping force applied to the intermediate member M in accordance with the amount the clamping member E1 is lifted by the lifting force FU. This decreases the compression amount of the intermediate member M. Thus, the reaction force FM is smaller than the reaction force F0 of FIG. 1(A).

On the other hand, in the high pressure pump of the prior art shown in FIG. 2(B), the member g that receives the reaction force FN from the pressurizing chamber I is arranged on the clamping side with the intermediate members m1, m2. In this case, the generated lifting force FU of the clamping member e1 resulting from the reaction force FN is an element of the axial force bf generated at the clamping bolts b1, b2. Another element of the axial force bf is the reaction force Fm from the intermediate members m1, m2 and the element g. Therefore, the axial force bf is represented by the following equation [4].

$$2\cdot bf=FU+Fm \quad [4]$$

The member g is arranged together with the intermediate member m1 between the clamping member e1 and the pressurizing chamber i. This causes the reaction force FN to increase the compression amount of the member g and the intermediate member m1. Therefore, the reaction force is almost same as the reaction force F0 in FIG. 1(B). Even if the reaction force FN decreases, the decreased degree is less than the difference between the reaction force F0 in FIG. 1(A) and the reaction force FM in FIG. 2(A). That is, FM<Fm. Therefore, in the state of FIGS. 2(A) and 2(B), Bf<bf is satisfied. As a result, in the high pressure pump of the present invention, when fluid in the pressurizing chamber is pressurized, an increase in the axial force of the clamping bolt is increased by the reaction force received from the pressurizing chamber. In other words, change in the axial force caused by fluid pressure pulsation during operation of the high pressure pump decreases. This enables the initial axial force of the clamping bolt to be relatively small. Therefore, the sealing surface and the cylinder form are prevented from being distorted.

Figure 3:
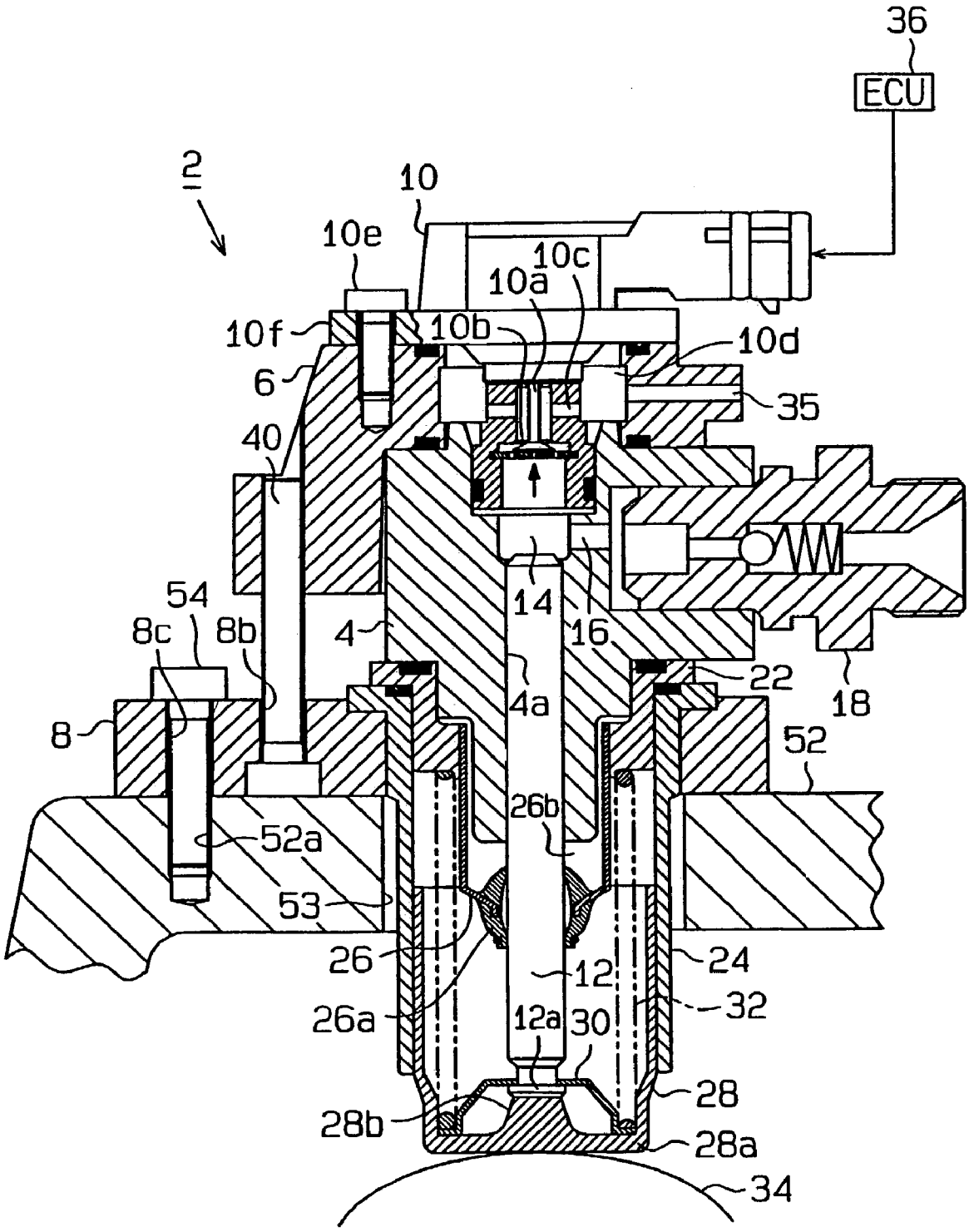
FIG. 3 is a cross sectional view of a high pressure pump according to an embodiment of the present invention.
Figure 4:
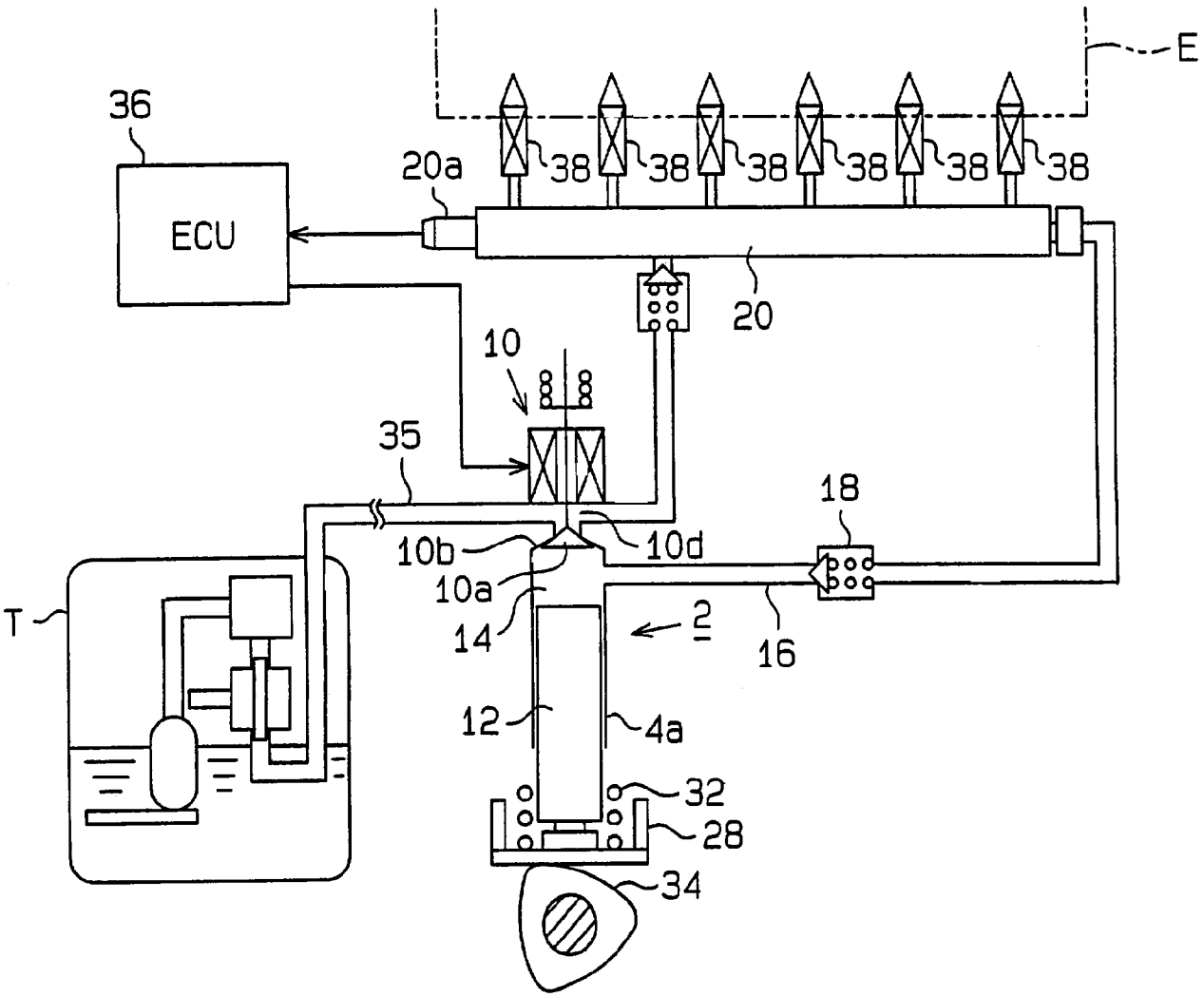
FIG. 4 is a schematic diagram of a fuel supplying system for an internal combustion engine incorporating the high pressure fuel pump.

FIG. 3 is a cross sectional view of a high pressure fuel pump 2 according to one embodiment of the present invention. The high pressure fuel pump 2 is incorporated in a cylinder injection type gasoline engine E, as shown in FIG. 4, and generates high pressure fuel injected into combustion chambers of the engine E.

As shown in FIG. 3, the high pressure fuel pump 2 has a cylinder body 4, a cover 6, a flange 8 and an electromagnetic spill valve 10. A cylinder 4*a* is formed along the axis of the cylinder body 4. A plunger 12 is supported in the cylinder 4*a* slidably in the axial direction. A pressurizing chamber 14, which is communicated with the cylinder 4*a*, is defined at the distal side of the cylinder 4*a* in the cylinder body 4. A volume of the pressurizing chamber 14 is varied as the plunger 12 moves into or out of the pressurizing chamber 14.

The pressurizing chamber 14 is connected to a check valve 18 via a fuel pressure supply passage 16. The check valve 18 is connected to a fuel distribution pipe 20 (FIG. 4). The check valve 18 is opened when the fuel in the pressurizing chamber 14 is pressurized and the high pressure fuel is supplied to the fuel distribution pipe 20.

A spring seat 22 and a lifter guide 24 are stacked upon each other at the lower side of the cylinder body 4. An oil seal 26 is attached to the inner surface of the spring seat 22. The oil seal 26 is generally cylindrical and has a lower portion 26*a* that slidably contacts the peripheral surface of the plunger 12. Fuel leaked from a space between the plunger 12 and the cylinder 4*a* is stored in a fuel storing chamber 26*b* of the oil seal 26 and returned to a fuel tank T via a fuel discharge passage (not shown), which is connected to the fuel storing chamber 26*b*.

A lifter 28 is accommodated in the lifter guide 24 slidably in the axial direction. A projected seat 28*b* is formed on an inner surface of a bottom plate 28*a* of the lifter 28. A lower end portion 12*a* of the plunger 12 engages the projected seat 28*b*. The lower end portion 12*a* of the plunger 12 is engaged with a retainer 30. A spring 32 is arranged between the spring seat 22 and the retainer 30 in a compressed state. The lower end portion 12*a* of the plunger 12 is pressed toward the projected seat 28*b* of the lifter 28 by the spring 32. The pressing force from the lower end portion 12*a* of the plunger 12 causes the bottom plate 28*a* of the lifter 28 to engage a fuel pump cam 34.

When the fuel pump cam 34 is rotated in cooperation with the rotation of the engine E, a cam nose of the fuel pump cam 34 pushes the bottom plate 28*a* upward and lifts the lifter 28. In cooperation with the lifter 28, the plunger 12 moves upward and narrows the pressurizing chamber 14. This lifting stroke corresponds to a fuel pressurizing stoke performed in the pressurizing chamber 14.

The electromagnetic spill valve 10 facing the pressurizing chamber 14 is closed at a proper timing during the pressurizing stroke. In the pressurizing process, prior to the closing of the electromagnetic spill valve 10, the fuel in the pressurizing chamber 14 returns to the low pressure side fuel tank T via a space between a seat 10*b* and a poppet valve 10*a* of the electromagnetic spill valve 10, a fuel passage 10*c*, a gallery 10*d*, and a low pressure fuel passage 35. Therefore, fuel is not supplied from the pressurizing chamber 14 to the fuel distribution pipe 20. When an electromagnetic circuit in the electromagnetic spill valve 10 causes the poppet valve

10*a* to come into contact with a seat 19*b*, the low pressure side fuel tank T and the pressurizing chamber 14 are disconnected (the state of FIG. 4). As a result, the pressure of the fuel in the pressurizing chamber 14 increases suddenly and generates high pressure fuel. This opens the check valve 18 with the high pressure fuel and supplies the high pressure fuel to the distribution pipe 20.

When the cam nose of the fuel pump cam 34 starts to move downward, the urging force of the spring 32 starts to gradually move the lifter 28 and the plunger 12 downward (intake stroke). When the intake stroke starts, the electromagnetic circuit in the electromagnetic spill valve 10 separates the poppet valve 10*a* from the seat 10*b* and opens the electromagnetic spill valve 10. This draws fuel into the pressurizing chamber 14 from the low pressure fuel passage 35 through the gallery 10*d*, the fuel passage 10*c*, and the space between the poppet valve 10*a* and the seat 10*b* (the state of FIG. 3).

The pressurizing stroke and the suction stroke are performed repeatedly. The closing timing of the electromagnetic spill valve 10 during the pressurizing stroke is feedback controlled to adjust the fuel pressure in the fuel distribution pipe 20 at the optimal pressure for injecting fuel from the fuel injection valve 38. The feedback control is executed by an electric control unit (ECU) 36 in accordance with the fuel pressure in the fuel distribution pipe 20, which is detected by a fuel pressure sensor 20*a*, and the running condition of the engine.

The cylinder body 4, the spring seat 22, and the lifter guide 24 form an intermediate member of the high pressure fuel pump 2 and are arranged between the cover 6 (second clamping member) and the flange 8 (first clamping member) in a stacked state. The electromagnetic spill valve 10 has a base plate 10*f*, and the base plate 10*f* is attached to the cover 6 by attaching bolts 10*e* at a side opposite to the side where the cylinder body 4, the spring seat 22, and the lifter guide 24 are clamped.

Figure 5:
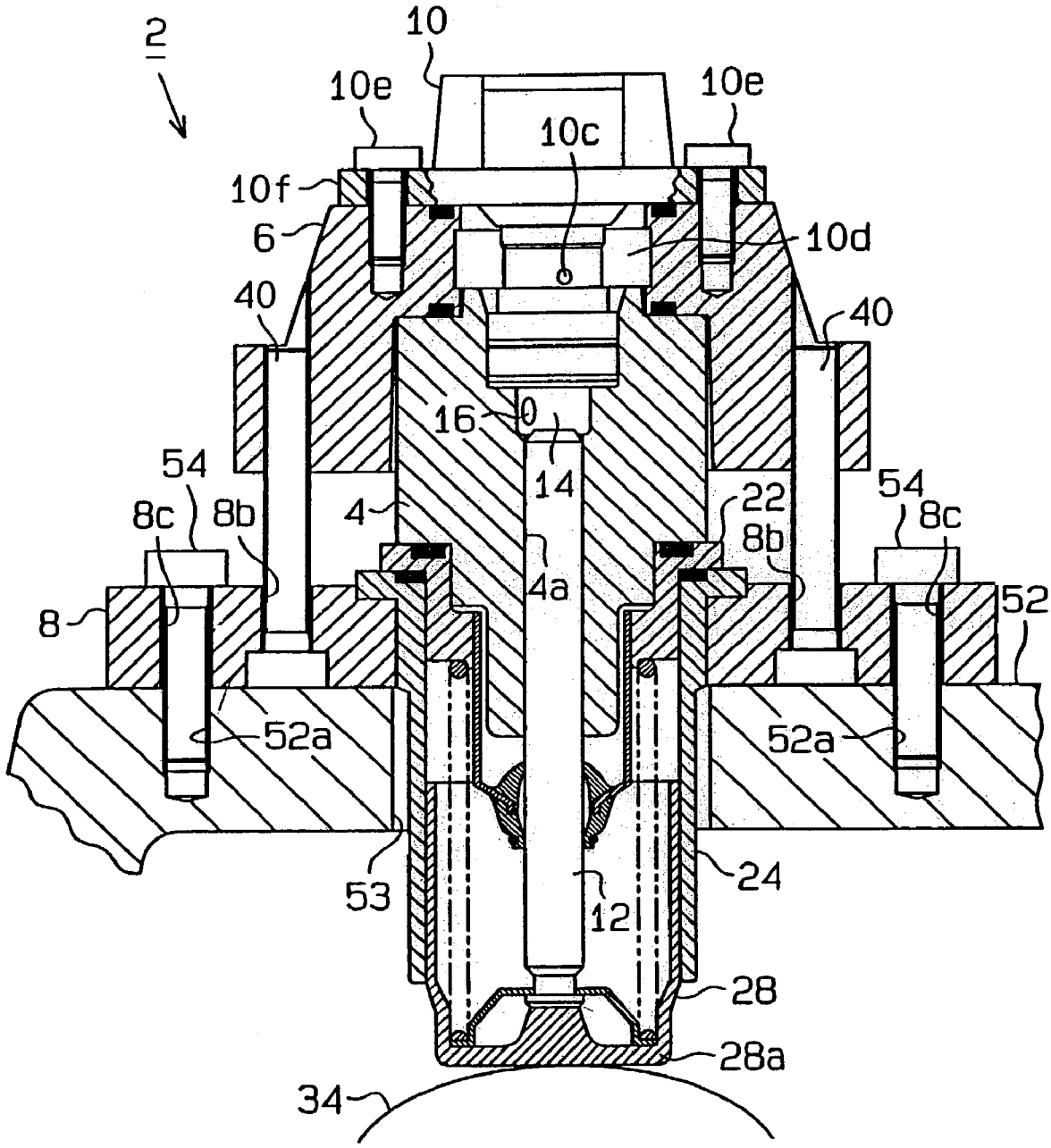
FIG. 5 is a cross sectional view of a high pressure pump according to an embodiment of the present invention.

The cylinder body 4, the spring seat 22, and the lifter guide 24 are clamped between the cover 6 and the flange 8 by clamping bolts 40 that extends between the cover 6 and the flange 8. In the cross sectional view of FIG. 3, the cross section at the right side of the axis of the high pressure fuel pump 2 differs from the cross section at the left side of the axis. That is, the left cross sectional half and the right cross sectional half are views taken at different cutting angles. Therefore, only one of a plurality of clamping bolts 40 is shown in FIG. 3. FIG. 5 shows a cross sectional view of the high pressure fuel pump 2 taken along the same cutting plane. As shown in FIG. 5, two clamping bolts 40 are arranged about the axis in a symmetric manner. In this embodiment, two sets of clamping bolts 40 are arranged in a symmetric manner around the cylinder body 4, the spring seat 22, and the lifter guide 24 to couple the cover 6 and the flange 8 to each other.

In the same manner, the attaching bolts 10*e* for fastening the electromagnetic spill valve 10 to the cover 6 are symmetrically arranged about the axis of the cylinder 12. In this embodiment, the base plate 10*f* of the electromagnetic spill valve 10 is attached to the cover 6 by two sets of the attaching bolts 10*e*.

The entire high pressure fuel pump 2 is fixed to a cylinder head cover 52, which serves as a supporting body, by a fastening bolt 54. The flange 8 has clamping bolt holes 8*b*, through which the clamping bolts 40 extend, and fastening bolt holes 8*c*, through which the fastening bolt 54 extend. The fastening bolt holes 8*c* are located closer to the peripheral portion than the clamping bolt holes 8*b*. The fastening bolts 54 are inserted in the fastening bolt holes 8*c* in a direction opposite to the direction of the clamping bolts 40 and screwed into screw apertures 52*a* formed in the cylinder head cover 52. In this embodiment, two sets of fastening bolts 54 are arranged symmetrically about the axis of the cylinder 12. In this manner, the high pressure fuel pump 2 is provided in the cylinder head cover 52. The bottom plate 28*a* of the lifter 28 is exposed from a through hole 53 of the cylinder head cover 52 and is engaged with the fuel pump cam 34 of the engine E. In this manner, the plunger 12 reciprocates in the cylinder 4*a* in cooperation with the rotation of the engine E.

The high pressure fuel pump 2 of the present invention has the following advantages.

(1) In the high pressure fuel pump 2, the cylinder body 4, the spring seat 22, and the lifter guide 24 are arranged between the cover 6 and the flange 8. The cylinder body 4, the spring seat 22 and the lifter guide 24 are clamped by the clamping bolts 40, which extend between the cover 6 and the flange 8.

The electromagnetic spill valve 10 is attached to the cover 6 on the side that is opposite to the side where the cylinder body 4, the spring seat 22 and the lifter guide 24 are clamped. The poppet valve 10*a* of the electromagnetic spill valve 10 receives the reaction force (the arrow of FIG. 3) from the pressurizing chamber 14 when coming into contact with the seat 10*b*. Therefore, as shown in FIGS. 1(A) and 2(A), an increase in the axial force of the clamping bolts 40, which results from the reaction force received by the electromagnetic spill valve 10 from the pressurizing chamber 14, is small in comparison to when the electromagnetic spill valve 10 is arranged on the same side as the cylinder body 4, the spring seat 22, and the lifter guide 24.

When the base plate 10*f* of the electromagnetic spill valve 10 receives the reaction force from the pressurizing chamber 14, the base plate 10*f* lifts the attaching bolts 10*e*. This lifts the cover 6 and reduces the clamping force applied to the cylinder body 4, the spring seat 22, and the lifter guide 24 is loosened. This decreases the reaction force that results from the clamping of the cylinder body 4, the spring seat 22, and the lifter guide 24. In this manner, even if the reaction force of the pressurizing chamber 14 is applied to the cover 6 by the fuel pressure pulsation produced during operation of the high pressure fuel pump 2, the reaction force resulting from the tightening of the cylinder body 4, the spring seat 22 and the lifter guide 24 decreases. Therefore, the total reaction force is smaller than the sum of the two reaction forces.

Accordingly, the axial force change caused by the fuel pressure pulsation when the high pressure fuel pump 2 is operated decreases. As a result, the initial axial force of the clamping bolts 40 decreases, and distortion of each sealing surface of the cover 6, the cylinder body 4, the spring seat 22, the lifter guide 24 and the flange 8 and distortion of the form of the cylinder 4*a* are prevented. This improves the durability of the high pressure fuel pump 2.

(2) The reaction force of the pressurizing chamber 14 applied to the attaching bolts 10*e* via the base plate 10*f* of the electromagnetic spill valve 10 acts in a direction for lifting the attaching bolts 10*e*. Therefore, the reaction force resulting from the elastic deformation of the base plate 10*f* near the attaching bolts 10*e* decreased as the fuel pressure increases. The initial axial force of the attaching bolts 10*e* also decreases, and distortion of the sealing surface of the electromagnetic spill valve 10 and the cover 6 is prevented.

Therefore, the present examples and embodiments are to be considered as illustrative and not restrictive and the invention is not to be limited to the details given herein, but may be modified within the scope and equivalence of the appended claims. The high pressure fuel pump of the present invention may be installed to a cylinder head of an engine.

What is claimed is:

1. A high pressure pump characterized by:

a plunger;

an intermediate member having a cylinder for accommodating the plunger and a pressurizing chamber communicated with the cylinder and including a cylinder body for pressurizing fluid in the pressurizing chamber by reciprocating the plunger;

two clamping members arranged on two sides of the intermediate member, wherein each of the two clamping members has elasticity;

a first clamping bolt extending from a first of the two clamping members to a second of the two clamping members to clamp the intermediate member with the two clamping members, the second clamping member having a side facing the first clamping member where the first clamping bolt meets the second clamping member, and the pressure of the fluid pressurized by the plunger being applied to the second clamping member;

a member for receiving reaction force from the pressurizing chamber when the fluid in the pressurizing chamber is pressurized, wherein the member for receiving the reaction force is attached to the second clamping member at a position for reducing the clamping force applied to the intermediate member by the clamping bolt and at a side of the second clamping member opposite to the side facing the first clamping member, wherein the member for receiving the reaction force includes a base plate; and a second clamping bolt for fastening the base plate to the second clamping member, wherein the first and second clamping bolts are located at positions that are different from each other in a direction perpendicular to a longitudinal direction of the plunger and close to each other when clamping, wherein the first clamping member is a flange-like member and the second clamping member has a body portion and a protrusion portion that is protruded from the body portion, and wherein the peripheral portion of the flange-like member and the protrusion portion receive the clamping force produced by the first clamping bolt.

2. The high pressure pump according to claim 1, wherein the member for receiving the reaction force is arranged facing the pressurizing chamber and functions as an electromagnetic valve for pressurizing the fluid in the pressurizing chamber by stopping movement of the fluid from the pressurizing chamber to a low pressure area.

3. The high pressure pump according to claim 1, wherein the fluid is fuel used for a cylinder injection type internal combustion engine.

4. The high pressure pump according to claim 3, wherein the first of the two clamping members is attached to a cylinder head cover of the internal combustion engine.

5. The high pressure pump according to claim 3, wherein the plunger is driven by a fuel pump cam rotated in cooperation with rotation of the internal combustion engine.

6. The high pressure pump according to claim 1, wherein the reaction force from the pressurizing chamber acts in a direction for lifting the second clamping bolt by means of the base plate.

7. The high pressure pump according to claim 1, wherein the clamping force produced by the first clamping bolt of the intermediate member and the clamping force of the second clamping bolt act in opposite directions along the axial direction of each clamping bolt.

8. The high pressure pump according to claim 7, wherein the first clamping bolt of the intermediate member and the second clamping bolt are arranged at positions separated from each other in the axial direction.

9. A high pressure pump characterized by:

a plunger;

an intermediate member having a cylinder for accommodating the plunger and a pressurizing chamber communicated with the cylinder and including a cylinder body for pressurizing fluid in the pressurizing chamber by reciprocating the plunger;

two clamping members arranged on two sides of the intermediate member, wherein each of the two clamping members has elasticity;

a first clamping bolt extending from a first of the two clamping members to a second of the two clamping members to clamp the intermediate member with the two clamping members, the second clamping member having a side facing the first clamping member where the first clamping bolt meets the second clamping member, and the pressure of the fluid pressurized by the plunger being applied to the second clamping member;

a member for receiving reaction force from the pressurizing chamber when the fluid in the pressurizing chamber is pressurized, wherein the member for receiving the reaction force is attached to the second clamping member at a position for reducing the clamping force, which is applied to the intermediate member by the clamping bolt, by lifting the second clamping member and at a side of the second clamping member opposite to the side facing the first clamping member, wherein the member for receiving the reaction force includes a base plate; and a second clamping bolt for fastening the base plate to the second clamping member, wherein the first and second clamping bolts are located at positions that are different from each other in a direction perpendicular to a longitudinal direction of the plunger and close to each other when clamping , wherein the first clamping member is a flange-like member and the second clamping member has a body portion and a protrusion portion that is protruded from the body portion, and wherein the peripheral portion of the flange-like member and the protrusion portion receive the clamping force produced by the first clamping bolt.

* * * * *